US008904976B1

(12) United States Patent
Ulve, Jr.

(10) Patent No.: US 8,904,976 B1
(45) Date of Patent: Dec. 9, 2014

(54) INTERNAL COMBUSTION ENGINE

(71) Applicant: Allan Dean Ulve, Jr., Leander, TX (US)

(72) Inventor: Allan Dean Ulve, Jr., Leander, TX (US)

(73) Assignee: Allan Dean Ulve, Jr., Leander, TX (US)

( * ) Notice: Subject to any disclaimer, the term of this patent is extended or adjusted under 35 U.S.C. 154(b) by 0 days.

(21) Appl. No.: 13/902,457

(22) Filed: May 24, 2013

(51) Int. Cl.
*F02B 75/16* (2006.01)

(52) U.S. Cl.
USPC ..... 123/73 FA; 123/61 R; 123/62

(58) Field of Classification Search
USPC ..... 123/61 R, 62, 73 FA
IPC ..... F02B 75/002,2075/1808
See application file for complete search history.

(56) References Cited

U.S. PATENT DOCUMENTS 1,471,847 A * 10/1923 Holliday ..... 123/51 B
1,817,510 A * 8/1931 Ewart ..... 123/50 R
2,569,269 A * 9/1951 Wilkins ..... 123/61 R
3,340,856 A * 9/1967 Brown ..... 123/61 R
4,708,099 A * 11/1987 Ekker ..... 123/53.4
7,412,949 B1 * 8/2008 Cillessen et al. ..... 123/63
2004/0099229 A1 * 5/2004 Gelfand ..... 123/63

* cited by examiner

*Primary Examiner* — M. McMahon
(74) *Attorney, Agent, or Firm* — Antony P. Ng; Russell Ng PLLC

(57) ABSTRACT

An internal combustion engine is disclosed. The internal combustion engine includes a head, a first and second cylinders, a first and second doubled-end pistons, a wrist pin, a connecting rod, and a crankcase. The first and second doubled-end pistons are disposed within the first and second cylinder, respectively. The wrist pin and the connecting rod are connected to the first and second doubled-end pistons. The crankcase contains a crankshaft connected to the connecting rod. The head, which is coupled to the first and second cylinders, includes a first and second spark plugs for associating with first ends of the first and second doubled-end pistons, respectively. The crankcase includes a third and fourth spark plugs for associating with second ends of the first and second doubled-end pistons, respectively.

4 Claims, 3 Drawing Sheets

INTERNAL COMBUSTION ENGINE

BACKGROUND OF THE INVENTION

1. Technical Field

The present invention relates to internal combustion engines in general, and in particular to a double-ended piston internal combustion engine.

2. Description of Related Art

Generally, internal combustion engines operation can be of two-cycle or four-cycle types. Various conventional mechanical designs have been implemented to improve on the functions of two-cycle and four-cycle internal combustion engines. Unfortunately, conventional mechanical designs often make internal combustion engines more complex and costly.

Consequently, it would be desirable to provide an internal combustion engine that has fewer moving parts, allowing for easier manufacturing and easier assembly.

SUMMARY OF THE INVENTION

In accordance with a preferred embodiment of the present invention, an internal combustion engine includes a head, a first cylinder, a second cylinder, a first doubled-end piston, a second doubled-end piston, a wrist pin, a connecting rod, and a crankcase. The first doubled-end piston is disposed within the first cylinder, and the second doubled-end piston is disposed within the second cylinder. The wrist pin and the connecting rod are connected to the first and second doubled-end pistons. The crankcase contains a crankshaft connected to the connecting rod. The head, which is coupled to the first and second cylinders, includes a first orifice for receiving a first spark plug to be associated with a first end of the first doubled-end piston, and a second orifice for receiving a second spark plug to be associated with a first end of the second doubled-end piston. The crankcase also includes a first orifice for receiving a third spark plug to be associated with the second end of the first doubled-end piston, and a second orifice for receiving a fourth spark plug to be associated with the second end of the second doubled-end piston.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
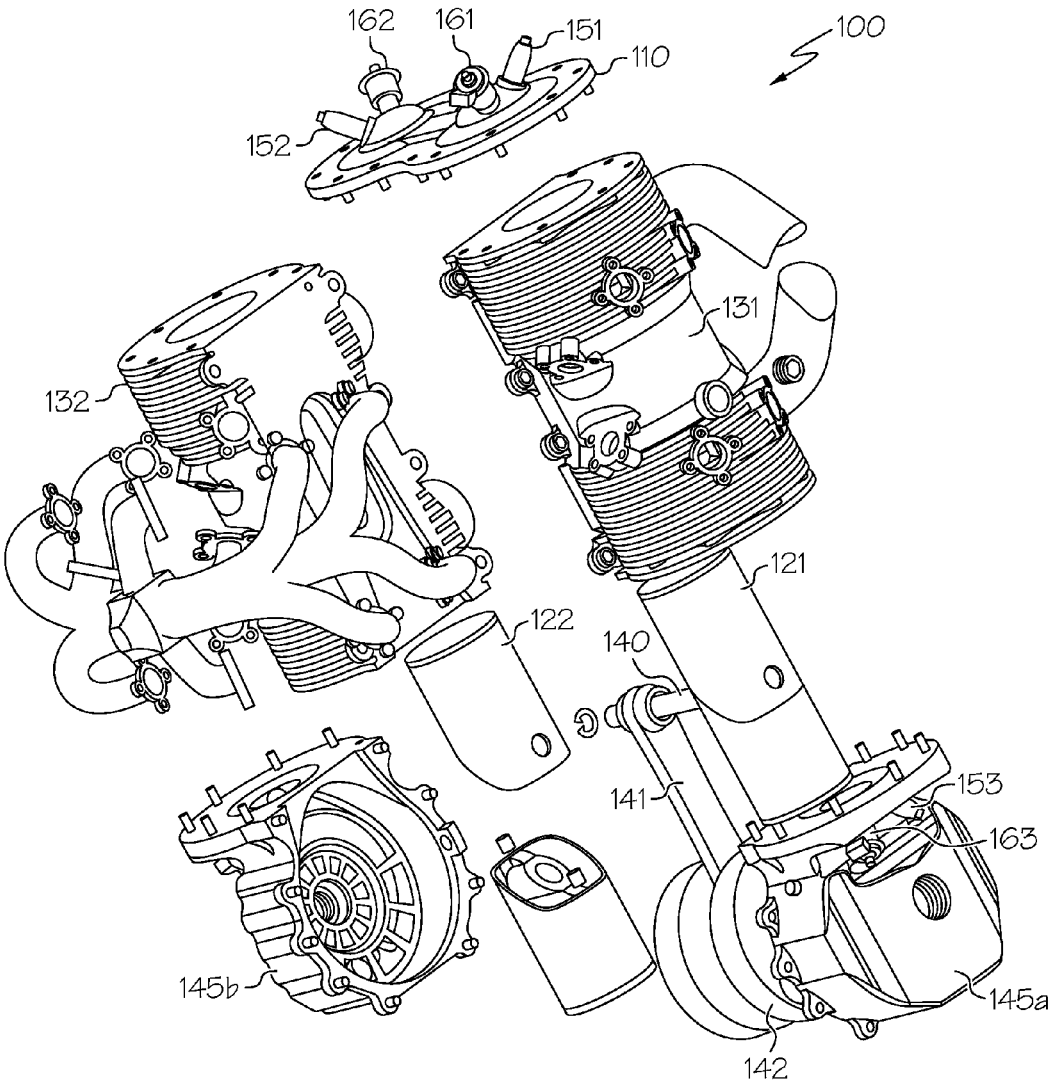
FIG. 1 is an exploded view of an internal combustion engine, in accordance with a preferred embodiment of the present invention.
Figure 2:
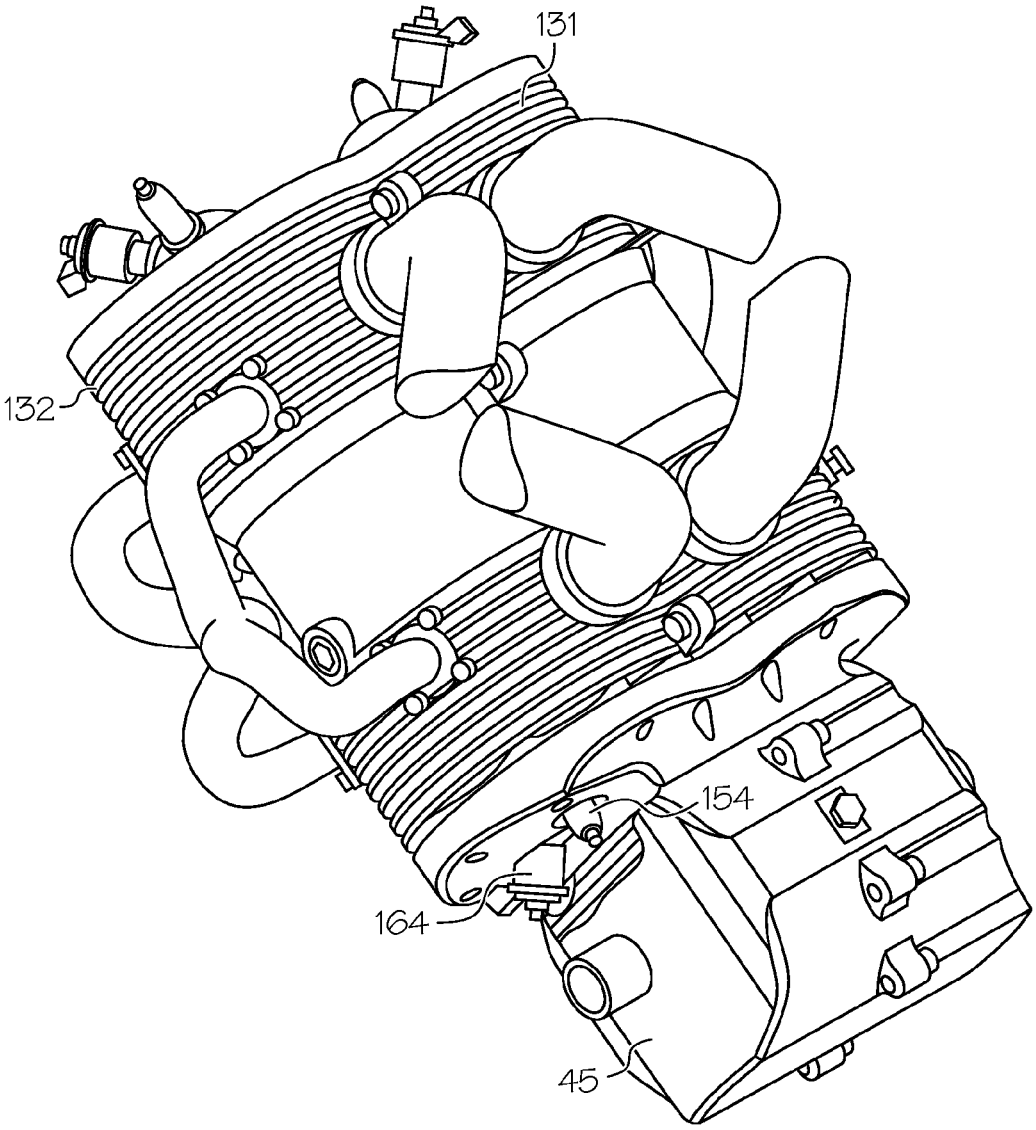
FIG. 2 is a perspective view of the internal combustion engine from FIG. 1.

Referring now to the drawings and in particular to FIGS. 1-2, there are illustrated an internal combustion engine in accordance with a preferred embodiment of the present invention. As shown, an internal combustion engine 100 includes a head 110, a first cylinder 131 and second cylinder 132, a first double-ended piston 121, a second double-ended piston 122, a wrist pin 140, a connecting rod 141, and a crank assembly 142. Crank assembly 142, which includes a crank and a crankshaft, is contained within a crankcase 145 (shown as 145*a* and 145*b* in FIG. 1).

Head 110 includes an orifice for receiving a spark plug 151 to be associated with a first end of first double-ended piston 121, and an orifice for receiving a spark plug 152 to be associated with a first end of second double-ended piston 122. Head 110 also includes an orifice for receiving a fuel injector 161 to be associated with a first end of first double-ended piston 121, and a second orifice for receiving a fuel injector 162 to be associated with a first end of second double-ended piston 122.

Crankcase 145 includes an orifice for receiving a third spark plug 153 to be associated with a second end of first double-ended piston 121, and a second orifice for receiving a fourth spark plug 154 to be associated with a second end of second double-ended piston 122. Crankcase 145 also includes an orifice for receiving a fuel injector 163 to be associated with a second end of first double-ended piston 121, and a second orifice for receiving a fuel injector 164 to be associated with a second end of second double-ended piston 122.

First double-ended piston 121 is disposed within first cylinder 131. Second double-ended piston 122 is disposed within second cylinder 132. Wrist pin 140 and connecting rod 141 are connected to first and second double-ended pistons 121, 122. Crankcase 145 contains a crankshaft connected to connecting rod 141.

Crank assembly 142 is disposed within crankcase 145 to change the downward and upward motions of double-ended pistons 121, 122 into rotating force.

Double-ended pistons 121, 122 can be installed into correct placement (alignment of piston wrist pin bosses with relation to connecting rod) within cylinder 131 and 132 in relation to connecting rod 141 with a top end bearing in place and atop the bottom-end assembly. When cylinders 131 and 132 are placed on crankcase 145, crankshaft assembly 142 is set at bottom dead center, and connecting rod 141 can be accessed through an access port.

Figure 3:
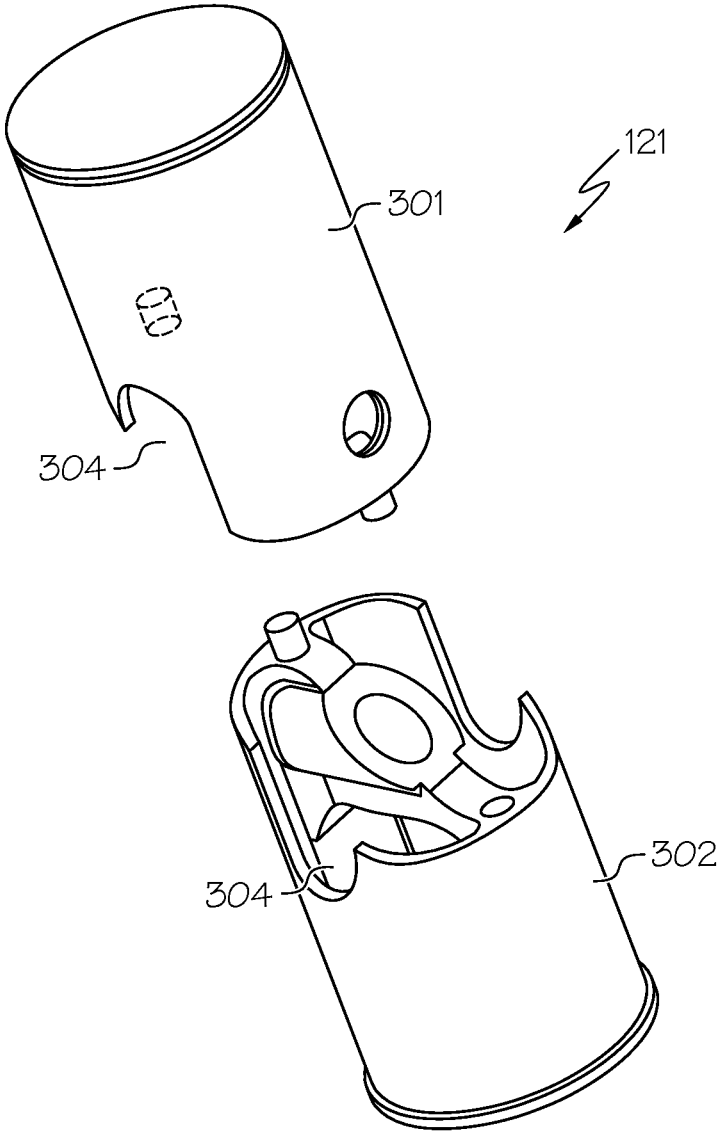
FIG. 3 is a detailed view of a double-end piston within the internal combustion engine from FIG. 1, in accordance with a preferred embodiment of the present invention.

Double-ended pistons 121 and 122 are substantially identical; thus, only double-ended piston 121 will be described in details. Referring now to FIG. 3, there is illustrated a detailed view of double-end piston 121, in accordance with a preferred embodiment of the present invention. As shown, double-ended piston 121 is composed of a half-piston 301 and a half-piston 302. Double-ended piston 121 includes a cutaway area 304 to aid air flow to cool an interior dome of double-ended piston 121. Cutaway area 304 helps to lower the operating temperature of double-ended piston 121. The flow of air occurs whenever cutaway areas 304 of double-ended piston 121 is inline with an intake port opening and an exhaust port opening, which allows for air flow to occur on each stroke.

Operations of internal combustion engine 100 may be implemented as set forth in Table I. In Table I, TDC stands for top dead center, BDC stands for bottom dead center, distal cylinder end refers to the end of the cylinder farthest from crankcase 112, and proximal cylinder end refers to the end of the cylinder closest to crankcase 112. It should be appreciated that the port timing descriptions are for reference only and may change to suit displacement and horsepower requirements. Both double-ended pistons 121 and 122 will be moved together by the rotation of crank assembly 142.

TABLE I

| Distal cylinder end | Proximal cylinder end |
|---|---|
| 0° pass TDC: piston at farthest TDC position in stroke from crank, compressed air charge captured between piston face and cylinder wall/head | 0° pass BDC: piston at closest BDC position in stroke for air charge to enter through exposed proximal intake ports |
| 60° pass TDC: crank rotates past TDC, no ports yet exposed | 60° pass BDC: piston closes proximal intake ports |
| 90° pass TDC: piston opens exhaust port, consumed air/fuel charge is released through exhaust ports | 90° pass BDC: piston closes exhaust port, compression begins |
| 120° pass TDC: piston opens intake ports, air charge enters | 120° pass BDC: compression continues |
| 180° pass TDC: piston at farthest proximal position, air charge continues through intake ports | 180° pass BDC: piston at furthest proximal position in stroke from crank, compressed air charge captured between piston face and cylinder wall/head |
| 240° pass TDC: piston closes distal intake ports | 240° pass BDC: no port yet exposed |
| 270° pass TDC: piston closes exhaust port, compression begins | 270° pass BDC: piston opens exhaust, consumed fuel/air charge released |
| 300° pass TDC: compression continues | 300° pass BDC: piston opens intake ports |
| 360° (0°): piston at farthest distal position | 360° (0°): air charge continues |

Internal combustion engine 100 may be designed with a bottom-end assembly that is light weight and compact. Crankcase assembly 142 may have an access port to facilitate the use of a connecting rod alignment tool to align connecting rod 141 and pistons 121, 122 during assembly. Internal combustion engine 100 may also be designed to facilitate use of a piston deck height tool that is configured to hold pistons 121, 122 at a predetermined height. For example, internal combustion engine 100 may be designed to facilitate access through a cylinder wall to aid in the installation of wrist pin 140, which generally facilitates an overall compact motor design. Internal combustion engine 100 may also be designed with split cylinders to allow for a more compact lightweight overall design and aid in assembly of the motor. Ports within cylinders 131, 132 may be laid out to accommodate piston ring set pin placement. Pistons 121, 122 may feature bearing points within a piston boss (i.e., wrist pin area) to distribute ignited chambers load.

As has been described, the present invention provides an improved internal combustion engine. The internal combustion engine of the present invention provides an efficient multi-cylinder internal combustion engine that is less complex than conventional internal combustion engines. The internal combustion engine of the present invention may be deployed in various applications in various fields, such as automotive, aviation, compressors, generators, ships, or any type of vehicle or equipment that currently utilizes internal combustion engines.

While the invention has been particularly shown and described with reference to a preferred embodiment, it will be understood by those skilled in the art that various changes in form and detail may be made therein without departing from the spirit and scope of the invention.

What is claimed is:

1. An internal combustion engine comprising:

a first and second cylinders;

a first double-ended piston disposed within said first cylinder;

a second double-ended piston disposed within said second cylinder, wherein said first and second double-ended pistons each includes a cutaway area that facilitates an flow to respective interiors of said first and second double-ended pistons;

a wrist pin and a connecting rod configured to connect to said first and second double-ended pistons;

a head coupled to said first and second cylinders, wherein said head includes a first orifice for receiving a first spark plug to be associated with a first end of said first double-ended piston, and a second orifice for receiving a second spark plug to be associated with a first end of said second double-ended piston; and a crankcase having a crankshaft connected to said connecting rod, wherein said crankcase includes a first orifice for receiving a third spark plug to be associated with a second end of said first double-ended piston, and a second orifice for receiving a fourth spark plug to be associated with a second end of said second double-ended piston.

2. The internal combustion engine of claim 1, wherein said crankcase further includes a first and second injector ports associated with said first and second cylinders, respectively.

3. The internal combustion engine of claim 1, wherein said head further includes a first and second injector ports associated with said first and second cylinders, respectively.

4. The internal combustion engine of claim 1, wherein said first and second pistons each include two sections to form one single piston.

* * * * *